US008397965B2

(12) United States Patent
Eberle

(10) Patent No.: US 8,397,965 B2
(45) **Date of Patent: *Mar. 19, 2013**

(54) BACKPACK WITH INCORPORATED GUN SCABBARD

(76) Inventor: Glen Richard Eberle, Boise, ID (US)

( * ) Notice: Subject to any disclaimer, the term of this patent is extended or adjusted under 35 U.S.C. 154(b) by 803 days.

This patent is subject to a terminal disclaimer.

(21) Appl. No.: 12/567,536

(22) Filed: Sep. 25, 2009

(65) Prior Publication Data

US 2010/0025446 A1 Feb. 4, 2010

Related U.S. Application Data

(63) Continuation-in-part of application No. 10/894,293, filed on Jul. 19, 2004, now Pat. No. 7,654,426, which is a continuation-in-part of application No. 10/355,495, filed on Jan. 31, 2003, now Pat. No. 6,763,987.

(51) Int. Cl.
*A45F 3/04* (2006.01)

(52) U.S. Cl. ..... 224/637; 224/652; 224/653; 224/913

(58) Field of Classification Search ..... None
See application file for complete search history.

(56) References Cited

U.S. PATENT DOCUMENTS 995,458 A * 6/1911 Harriman ..... 224/651
1,296,619 A * 3/1919 Bulat ..... 224/160
4,693,402 A 9/1987 Comeau
4,754,904 A 7/1988 Fischer
4,756,456 A 7/1988 Schauer
D311,813 S 11/1990 Oliver
5,016,793 A 5/1991 Derkatz
5,131,576 A 7/1992 Turnipseed
5,492,255 A 2/1996 Gansky
5,576,166 A 11/1996 Sugita
5,603,441 A 2/1997 Easter
5,664,721 A 9/1997 Homeyer
5,669,170 A 9/1997 Norris
5,791,537 A 8/1998 Miller
5,806,742 A 9/1998 Mott
5,961,017 A 10/1999 Mehler
6,119,907 A 9/2000 Benjamin
6,152,338 A 11/2000 Smith
6,179,188 B1 1/2001 Gleason
6,185,738 B1 2/2001 Sidebottom
6,196,437 B1 3/2001 Smith, III
6,290,114 B1 9/2001 Berberian
6,336,576 B1 1/2002 Easter
6,345,744 B1 * 2/2002 Eldridge ..... 224/153
6,367,674 B1 4/2002 Tabor
6,520,390 B2 2/2003 Verdugo
6,619,519 B1 9/2003 Nix
6,763,987 B1 * 7/2004 Eberle ..... 224/637
7,654,426 B2 * 2/2010 Eberle ..... 224/637
2004/0173655 A1 9/2004 Markson
2007/0145092 A1 * 6/2007 Eberle ..... 224/650

* cited by examiner

*Primary Examiner* — Gary Elkins
(74) *Attorney, Agent, or Firm* — Robert L. Shaver; Dykas & Shaver

(57) ABSTRACT

A backpack and a method of forming a backpack with an integral gun scabbard has been devised whereby the user has a convenient place for the storage and carriage of a rifle, shotgun, or other long gun type of firearm, and simultaneously can store and carry a variety of other sundry cargo while moving about. The backpack is devised in such a way as to permit easy and rapid access to and retrieval of said firearm from the storage. It is equipped with dual padded shoulder straps. In an ideal embodiment, a waist belt is included to facilitate the stabilization of the scabbard when the firearm is being withdrawn, as well as to contribute to the load bearing functions of the backpack.

19 Claims, 3 Drawing Sheets

BACKPACK WITH INCORPORATED GUN SCABBARD

PRIORITY/CROSS-REFERENCE TO RELATED APPLICATIONS

This application is a continuation-in-part application of application Ser. No. 10/894,293 filed on Jul. 19, 2004, which was a continuation-in-part application of application Ser. No. 10/355,495 filed on Jan. 31, 2003, which issued as U.S. Pat. No. 6,763,987 on Jul. 20, 2004, the disclosure of which is incorporated herein by reference.

FIELD OF THE INVENTION

The present invention relates to backpacks in general, and more particularly to backpacks which include a built-in gun scabbard.

BACKGROUND OF THE INVENTION

There are various times that a person needs to carry both a backpack and a gun, and weight is carried much more conveniently using the shoulder and waist belt suspension system of a backpack than when it is carried in a person's arms. For this reason, it is much easier for a person to carry a gun in their backpack than to carry a backpack and a gun separately.

There are prior art gun and scabbard combinations which are designed so that part of the gun extends out of the scabbard and is available for quick and easy retrieval by the person wearing the backpack. The patent applications of the inventor include this feature, and allow a gun to be removed from a scabbard in a backpack without stopping and removing the backpack.

Other situations occur in which protection and concealment of the gun may be more important than rapid withdrawal. In the case of military snipers, if a patrol of soldiers includes a sniper, the enemy may target the sniper with anti-sniper fire, or target the sniper in a fire fight. In such situations, it would be preferable for the sniper in a patrol of snipers to not identify himself as a sniper. In order to do that, it would be desirable to have a pack which had the external appearance of any other pack, but which had a compartment for a concealed weapon.

SUMMARY OF THE INVENTION

The invention is a backpack which includes a main panel with a top, bottom, left and right side edges, a front side and a rear side. The backpack also includes a pair of shoulder straps with each strap having a first end and a second end, with the first end of each strap attached to the top rear side of the main panel and with the second end of the shoulder strap attached near the bottom rear side of the main panel. The pack includes a gun scabbard which is attached to the front side of the main panel. The gun scabbard has a top edge and a scabbard bottom, with scabbard left and right sides. The scabbard can be generally two sided with the two sides joined to each other by a zipper. It can also be more of a six sided structure with a front and a back side and a left and a right side. The gun scabbard defines a general gun shaped space within the sides, top and bottom of the scabbard.

The pack further includes a storage container which is attached to the front side of the main panel of the back. It can also be attached to a side of the gun scabbard, in an instance in which the gun scabbard covers the entire front side of the main panel. Thus, the gun scabbard defines a space which is suitable for enclosing and storing the entire gun, with no part of the gun sticking out of the pack, nor above the top edge of the scabbard. The gun scabbard and the storage container may be constructed so that the gun scabbard covers the entire front side of the main panel of the pack with the storage compartment attached to the edges of the gun scabbard. The gun scabbard can also cover a part of the main panel, with the pack storage compartment or a portion of it, attached to the scabbard and the main panel of the pack.

The scabbard can include a closure for the scabbard top which would secure a gun within the scabbard. The closure can be a pair of straps over the open top of the scabbard or it could also be a flap or a zipper which covers the scabbard, or which covers the top of the pack including the scabbard.

In the case of a flap which covers the entire pack, a zipper may be present in the flap covering the top of the pack which could be opened for removal of the gun from the scabbard through the zippered opening.

The storage compartment may be attached to the scabbard and the main panel of the pack in such a way that the entire storage compartment is removable from the scabbard, which would leave the scabbard attached to the main panel of the pack with part or the entire storage compartment of the pack removed.

The scabbard may be a generally rigid chamber, or it may also be compressible and have an open configuration and a flattened configuration. The flattened configuration could be achieved by a zipper around the edge of two sides of the scabbard. When the zipper is opened, the scabbard would be released from the flattened position and could move into the open configuration for storage of a gun. In this way, the pack of the invention could serve as a regular backpack when a gun is not being carried in the pack, and would maintain a compact configuration for carrying, until a gun needed to be inserted into the scabbard.

The scabbard of the backpack may also extend beyond the bottom of the storage container, and be foldable in the center of its length so that when not used for a long gun, the lower end of the scabbard could be folded and enclosed within the storage compartment. In one configuration, the storage compartment can have an opening adjacent the side of the scabbard, and the lower end of the scabbard may be folded over and extended through the opening in the storage compartment and secured in a folded position inside the storage compartment.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
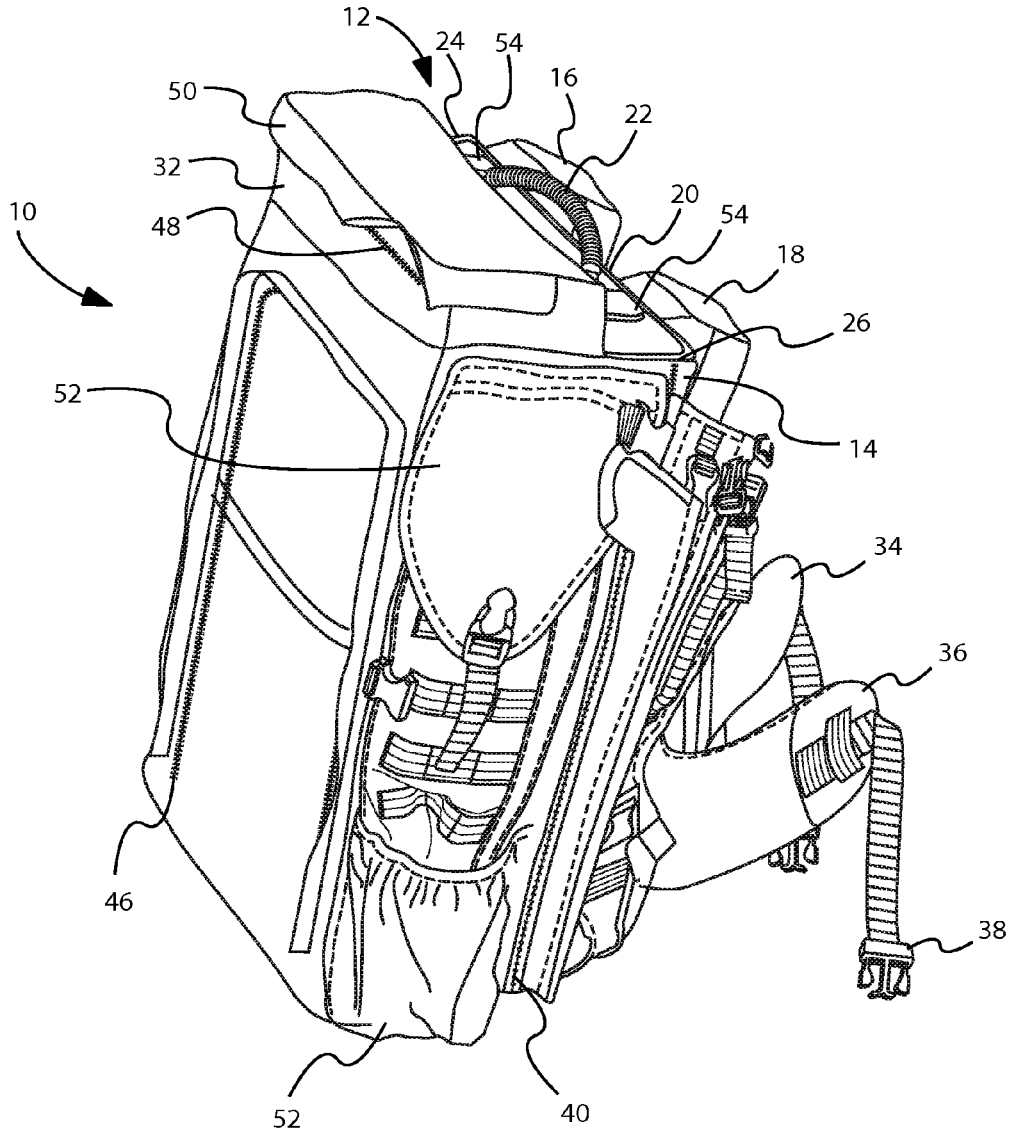
FIG. 1 is a perspective view of the backpack of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

The backpack of the invention is shown to advantage in FIGS. 1-5. FIG. 1 shows the backpack with scabbard designated as 10. The backpack includes a main panel 12 which is not visible in FIG. 1, but is more visible in FIG. 4. Attached to the main panel 12 is a scabbard 14 which may cover the entire width of the main panel 12 or a portion of that width, and the full length of the main panel 12 or a portion of that length. The main panel 12 includes a front side 28 and a rear side 30 which are shown to advantage in FIG. 5. As shown in FIG. 1, a storage compartment 32 is attached to the scabbard 14. The scabbard 14 is made up of a front side 20 a back side 22 a left side 24 and a right side 26. The pack includes a left shoulder strap 16 and a right shoulder strap 18. The pack also includes a left waist belt 34 and a right waist belt 36. The waist belt includes a buckle 38 with a portion of the buckle on each of the left waist belt 34 and the right waist belt 36, which join together to attach the waist belt around the user's waist.

The storage compartment 22 can be attached as shown in FIG. 1 to the scabbard 14 by an attachment zipper 40. In the version shown in FIG. 1, the attachment zipper 40 extends along the right and left side of the pack and can also extend along the bottom and/or top side of the pack, and serve to join the scabbard 14 to the storage compartment 32. The pack can be configured so that when the attachment zipper 40 is completely unzipped, the storage compartment 32 can be completely removed from the scabbard 14, leaving the scabbard 14 attached to the main panel 12 with its attached shoulder straps 16 and 18. The storage compartment 32 can further include a pair of auxiliary shoulder straps 42 and 44. These would typically be a compact version of shoulder straps made of nylon webbing material, which would be hidden between the scabbard 14 and the storage compartment 32 in normal use and when these are attached to each other. When the storage compartment 32 is removed from the scabbard the auxiliary shoulder straps 42 and 44 would become available so that the backpack with scabbard 10 of the invention could be divided to form two functional packs, each with their own set of shoulder straps. The scabbard would be attached to the shoulder straps 16 and 18 and the storage compartment 32 would be attached to the shoulder straps 42 and 44.

The storage compartment 32 also contains a back access zipper 46 which can be opened to allow the user to access the equipment stored in the interior of the storage compartment 32. The storage compartment can also include a top zipper 48 which would typically be hidden by a rain flap 50 as shown in FIG. 1. The storage container 32 also contains one or more side pockets 52 which can include a pocket cover flap or be an open top pocket as shown in FIG. 1. The top of the scabbard can be a generally open top compartment and can be secured with scabbard straps 54 as shown in FIG. 1. The scabbard 14 surrounds and defines a space which is generally gun shaped, and which is sufficient in volume in every dimension to store a gun without the gun sticking out. This could include a folding or modular weapon, or a one piece gun. The scabbard 14 is configured so that it can be used with a gun which is selected to fit inside the scabbard.

Figure 2:
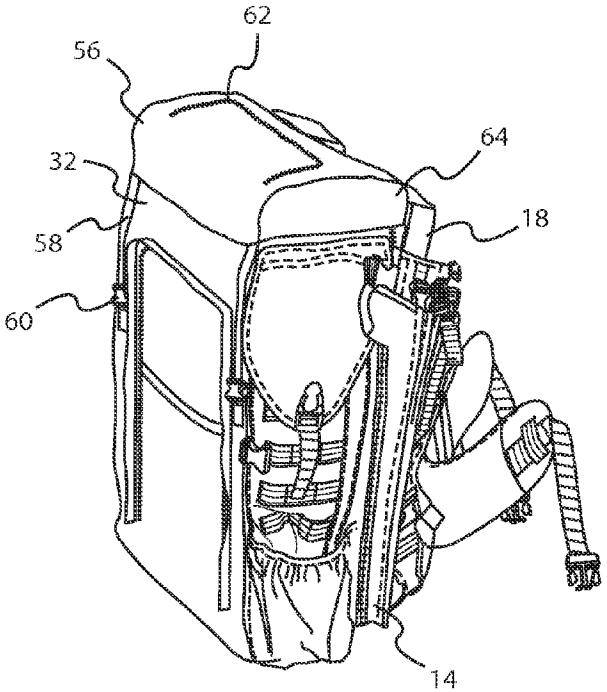
FIG. 2 is a perspective view of the backpack of the invention with a zippered scabbard access.

FIG. 2 shows another preferred embodiment of the invention. This version includes a similar scabbard 14 and storage compartment 32 as shown in FIG. 1, with an additional feature being a covering flap 56. The covering flap 56 is secured by one or more securing straps 58, which attach to the storage compartment 32 with a strap buckle 60. The covering flap 56 includes a top access zipper 62. The top access zipper is shown as generally U shaped in FIG. 2, but can also be straight or curved. It is important that the top access zipper 62 be positioned over the top of the scabbard 14 when the covering flap 56 is secured over the top of the pack, so that a gun enclosed within the scabbard may be accessed through the top access zipper 62.

The covering flap 56 can be a single layer of fabric or can be built to include an auxiliary storage compartment 64. If built to include an auxiliary storage compartment 64, the covering flap 56 is configured to provide a straight through access tunnel 66 to the scabbard 14 positioned below the top access zipper 62.

Figure 3:
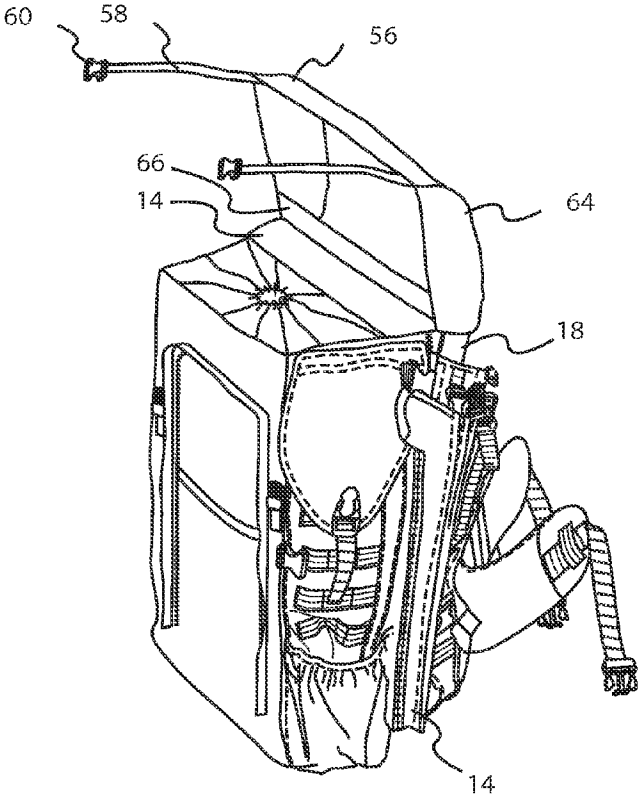
FIG. 3 is a perspective view of the backpack of the invention with a cover flap opened.

FIG. 3 is a view of the same pack as in FIG. 2, but with the covering flap 56 opened. Shown in FIG. 3 is an access tunnel 66 in the covering flap 56, which provides a direct access route to the scabbard 14. FIG. 3 shows the scabbard 14 divided into two chambers or it may also be configured as one chamber as wide as the main panel.

Figures 4, 5:
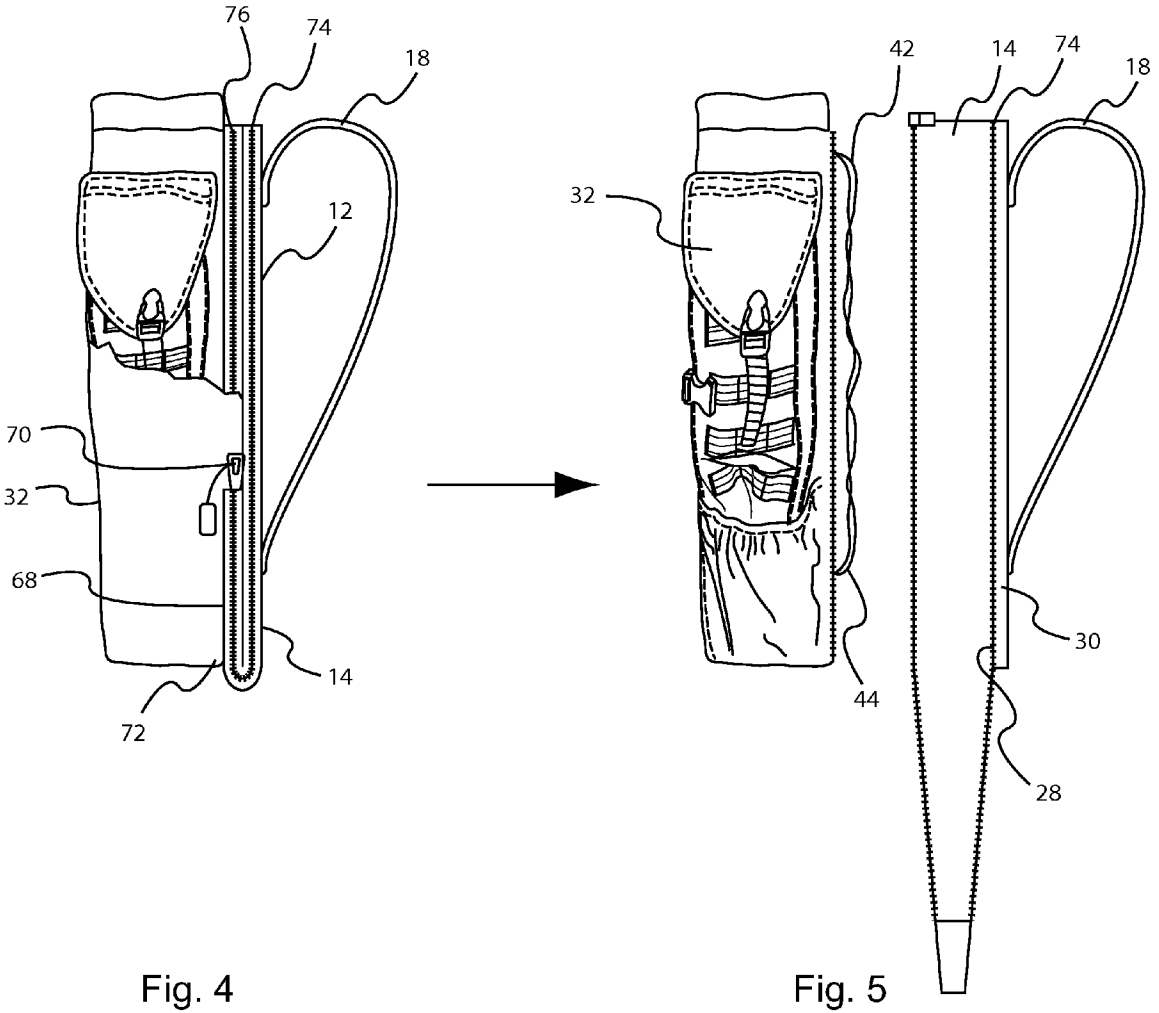
FIG. 4 is a side cutaway view of the backpack of the invention with a folding scabbard.
FIG. 5 is a side view of the backpack of the invention with the storage compartment separated from the scabbard.

FIG. 4 shows a side cut-away version of the backpack of the invention, in which the scabbard 14 includes a folding barrel portion 68. This part of the scabbard is folded against the upper part of the scabbard inside, and secured in place. The folding barrel portion 68 would thus be secured inside the storage compartment 32 and would not be visible from the outside. In the version shown in FIG. 4 the tip of the scabbard is secured using a scabbard tip strap 70, but other methods of securing the tip of the scabbard in position are also possible such as by the use of hook and loop fabric, ties, zippers or other means of attachment. As shown in FIG. 4 the pack of this design includes a scabbard slot 72 through which the folding barrel portion 68 of the scabbard may be extended out of the storage compartment 32, or folded into the storage compartment and secured. The scabbard of this design includes a side zipper 74 with which the volume of the scabbard can be reduced. FIG. 4 shows the scabbard with the side zippers closed, and the sides of the scabbard flattened to a minimum volume. FIG. 5 shows the side zipper 74 of the scabbard zipped open to allow the scabbard to expand to a larger volume. This version of the backpack also includes a pack zipper 76. The pack zipper 76 is a zipper in which one half of the zipper is attached to an edge of the scabbard, and the other half of the zipper is attached to the edges of the storage compartment 32. When the two edges are zipped together, the storage compartment 32 is attached to the scabbard 14. The pack zipper 76 can also be unzipped, which allows the storage compartment 32 to be removed completely from the scabbard 14. The storage compartment 32 can include auxiliary shoulder straps 42 and 44 so that the scabbard can become a separate scabbard bearing pack with shoulder straps, and the storage compartment 32 can also become a separate and independent pack with shoulder straps.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A backpack comprising, in combination:

a main panel, generally rectangular in shape, having a top a bottom, two side edges, a front side, and a rear side;

a pair of shoulder straps with each strap having a first end and a second end, with said straps symmetrically mounted to said main panel, with said first end attached proximal top rear side of said main panel, with said second end of each strap being fixedly attached proximal said bottom rear side of said main panel; and a gun scabbard, attached to the front side of said main panel, said scabbard having top edge positioned approximately level with said top edge of said main panel, and with said scabbard defining a generally gun shaped space within sides, top and bottom of said scabbard; and a storage container removably attached to the front side of said main panel, said storage container having a front panel, a rear panel, two side panels, a top panel, and a bottom panel, fixedly attached to one another so as to form a container with an interior space, this container having at least one access aperture which is fitted with a zipper or some such similar selectively releasable device, with said storage container further comprising a pair of auxiliary shoulder straps which allow said storage container to be carried as a separate backpack when removed from said main panel.

2. The backpack of claim 1 in which said gun scabbard is removably attached to said main panel.

3. The backpack of claim 1 which further comprises a closure for said scabbard top edge.

4. The backpack of claim 1 in which said scabbard is compressible from an open configuration suitable for insertion of a gun, to a flattened position for use without an enclosed gun.

5. The backpack of claim 4 in which said scabbard comprises a circumference zipper which, when closed, holds the scabbard in a flattened position and when opened, allows the scabbard to expand to said open configuration, with sufficient volume to accommodate a gun.

6. The backpack of claim 3 in which said scabbard closure is comprised of a closable pack top opening which allows access to an interior of said storage container, so that when said pack opening is closed, said scabbard top is enclosed within said pack.

7. The backpack of claim 3 in which said scabbard closure is a zipper in said storage container.

8. The backpack of claim 1 which further comprises a closure flap attached to said top of said main panel, with said flap having attachment ends which attach to said storage container for securement, with said closure flap configured to cover said scabbard top.

9. The backpack of claim 1 in which said scabbard is longer than said storage container, and includes a folding barrel portion, with said barrel portion of the scabbard being foldable so that the folded scabbard is substantially the same length as the storage container, and when unfolded, the scabbard extends beyond the bottom of the storage container, and is configured to enclose a gun.

10. The backpack of claim 7 in which said storage compartment includes an opening through which said barrel portion of said scabbard may be extended and secured, so that said barrel portion when folded is fully enclosed within said storage compartment.

11. The backpack of claim 8 in which said storage compartment is attachable and removable from said scabbard.

12. The backpack of claim 1 wherein additional storage containers may be either fixedly or removably attached in such manner as to overlay said scabbard and said storage container.

13. The backpack of claim 1 wherein all said storage container may be further internally subdivided into various and separate cells, each with its separate access aperture and selectively releasable mechanism for closure.

14. The backpack of claim 1 wherein said scabbard is positioned in an approximately vertical orientation, with the top edge of its rear panel proximate said top edge of said main panel of backpack.

15. The backpack of claim 1 which further comprises an external rigid frame to which is attached said main panel and said shoulder straps.

16. A backpack comprising, in combination:

a main panel, generally rectangular in shape, having a top a bottom, two side edges, a front side, and a rear side;

a pair of shoulder straps with each strap having a first end and a second end, with said straps symmetrically mounted to said main panel, with said first end attached proximal top rear side of said main panel, with said second end of each strap being fixedly attached proximal said bottom rear side of said main panel; and a gun scabbard, removably attached to the front side of said main panel, said scabbard having top edge positioned approximately level with said top edge of said main panel, and with said scabbard defining a generally gun shaped space within sides, top and bottom of said scabbard, with said scabbard formed to be longer than said storage container, with a folding barrel portion of said scabbard, with said folding barrel portion of the scabbard being foldable so that the folded scabbard is substantially the same length as the storage container, and when unfolded, the scabbard extends beyond the bottom of the storage container, and is configured to enclose a gun; and a storage container removably attached to the front side of said main panel, said storage container having a front panel, a rear panel, two side panels, a top panel, and a bottom panel, fixedly attached to one another so as to form a container with an interior space, this container having at least one access aperture which is fitted with a zipper or some such similar selectively releasable device, with said storage container further comprising a pair of auxiliary shoulder straps which allow said storage container to be carried as a separate backpack when removed from said main panel.

17. The backpack of claim 16 in which said scabbard comprises a circumference zipper which, when closed, holds the scabbard in a flattened position and when opened, allows the scabbard to expand to said open configuration, with sufficient volume to accommodate a gun.

18. The backpack of claim 16 which further comprises a closure flap attached to said top of said main panel, with said flap having attachment ends which attach to said storage container for securement, with said closure flap configured to cover said scabbard top.

19. The backpack of claim 16 in which said storage compartment includes an opening in which said barrel portion of said scabbard may be inserted and secured, so that said barrel portion when folded is fully enclosed within said storage compartment.

* * * * *